US011440079B1

(12) United States Patent
Schlipf

(10) Patent No.: US 11,440,079 B1
(45) Date of Patent: Sep. 13, 2022

(54) METHOD FOR PRODUCING AN ELECTRICAL BUSHING

(71) Applicant: Türk & Hillinger GmbH, Tuttlingen (DE)

(72) Inventor: Andreas Schlipf, Tuttlingen (DE)

(73) Assignee: TURK & HILLINGER GMBH, Tuttlingen (DE)

( * ) Notice: Subject to any disclaimer, the term of this patent is extended or adjusted under 35 U.S.C. 154(b) by 0 days.

(21) Appl. No.: 17/549,011

(22) Filed: Dec. 13, 2021

(30) Foreign Application Priority Data

Nov. 3, 2021 (DE) ..... 10 2021 128 643.3

(51) Int. Cl.
*H01B 17/26* (2006.01)
*B21D 53/00* (2006.01)

(52) U.S. Cl.
CPC ..... *B21D 53/00* (2013.01); *H01B 17/26* (2013.01)

(58) Field of Classification Search
CPC ..... H01B 19/00; H01B 17/26; H01B 13/06; H01B 17/30; H01B 17/301; H01B 17/303; H01B 17/56; H01B 17/583; H01B 17/60; B21D 53/00; H02G 3/22; H02G 3/24; H02G 3/26; H02G 3/04; H02G 3/30; H02G 3/36; H02G 3/083
USPC ..... 174/650, 152 R, 153 R, 172, 40 R, 31 R, 174/140 R, 262; 439/371, 39; 336/107, 336/137, 138
See application file for complete search history.

(56) References Cited

U.S. PATENT DOCUMENTS 5,281,767 A * 1/1994 West ..... H01B 17/26 174/152 R
6,610,933 B2 * 8/2003 Baker ..... H01F 27/04 174/152 R
7,652,212 B2 * 1/2010 Stacy ..... H01B 19/04 174/152 R
7,875,803 B2 * 1/2011 Sjoberg ..... H01B 17/308 336/107

(Continued)

FOREIGN PATENT DOCUMENTS

DE 102012005786 A1 9/2013
DE 102012110098 A1 4/2014
DE 102016209282 A1 11/2017

OTHER PUBLICATIONS

Office Action dated Jul. 6, 2022 in German Application No. 102021128643.3.

*Primary Examiner* — Angel R Estrada
(74) *Attorney, Agent, or Firm* — Panitch Schwarze Belisario & Nadel LLP

(57) ABSTRACT

A method for producing an electrical bushing with a multi-part inner conductor arranged at least in some sections in an outer tube made from metal and electrically insulated from the outer tube by an electrically insulating material. The inner conductor of the finished bushing has at least one contact section protruding out of the outer tube and a bearing section that is arranged within the outer tube and that is compressed with the electrically insulating material. The outer tube made from metal to form a composite for supporting the at least one contact section. The at least one contact section and the bearing section compressed with the electrically insulating material and the outer tube made from metal to form the composite for supporting the at least one contact section are prepared as separate assemblies and then connected to each other.

13 Claims, 4 Drawing Sheets

(56) References Cited

U.S. PATENT DOCUMENTS

| | | | | |
|---|---|---|---|---|
| 8,276,514 | B2 * | 10/2012 | Fink | F42B 3/198 65/59.1 |
| 10,941,688 | B2 | 3/2021 | Hirth et al. | |
| 2003/0234115 | A1 | 12/2003 | Deng et al. | |
| 2015/0011115 | A1 | 1/2015 | Hirth et al. | |

* cited by examiner

METHOD FOR PRODUCING AN ELECTRICAL BUSHING

CROSS-REFERENCE TO RELATED APPLICATIONS

This application claims priority under 35 U.S.C. § 119(b) to German Patent Application No. 10 2021 128 643.3, filed on Nov. 3, 2021, the disclosure of which is incorporated herein by reference in its entirety.

BACKGROUND OF THE INVENTION

Electrical bushings are needed especially when an electrical conductor is supposed to be passed through an electrically conductive material without forming an electrical contact between the electrical conductor and the electrically conductive material. These bushings usually have an electrical conductor, an insulator that provides the electrical insulation, and a sheath through which the conductor is supposed to be led and through which the connection to the electrically conductive material can be made.

There is a series of applications, for example, in the automotive industry, in which such bushings are exposed to extremely high loads. If one considers, for example, an electrical exhaust gas heating system of a catalytic converter for a motor vehicle, then the power supply for the exhaust gas heating system must be passed, in an isolated arrangement, through the wall of the exhaust pipe in which the exhaust gas flows.

Such a catalytic converter heating system is often suspended in the exhaust pipe in an arrangement isolated from the exhaust pipe, which is realized partially by means of insulating pins in the interior of the exhaust pipe but also at least partially by producing a mechanical connection of the conductor of the electrical bushing extending into the pipe interior, in particular, by welding or soldering.

In addition, the electrical conductor of the bushing often has a thread for securing an electrical connection. Processes for tightening and loosening this connection produce considerable torsional forces in addition to compression and tension forces.

When used in a situation like this, the electrical bushing must therefore be able to withstand long-term and continuous high temperature loading on one hand and high vibrational loading as well as shocks and impacts during vehicle operation on the other. Therefore, it is particularly important that the electrical bushing has high mechanical stability and tensile strength and high resistance to torsion.

For producing such electrical bushings, it is known from the state of the art to prepare the electrical conductor that must be made from high-grade materials, e.g., NiCr8020, in many applications as a semifinished part formed into the desired shape, for example, by turning, milling, and/or thread rolling, then to push on an insulating tube that is typically made from a ceramic insulating material, in particular, from a porous MgO body made of, e.g., C820, and then to mount this arrangement in the interior of an outer tube, which can be made from, e.g., stainless steel. After this arrangement of electrical conductor, insulating tube, and outer tube is assembled, it is compressed, in particular, compacted, in a way that reduces its cross section, so that the electrical bushing is produced.

The practice shows that this type of production of electrical bushings is associated with a series of problems. Because each electrical bushing must be individually mounted and compressed, it is associated with rather high costs. The degree of compression to be achieved varies namely such that it decreases in the direction toward the ends of the outer tube of the electrical bushing. This has the result that these areas have only a limited stabilizing effect against mechanical loading, especially in the form of impacts, tension, torsion, or vibration; in addition, this also increases the likelihood of exhaust gas being able to escape.

This is particularly relevant because the length of the outer tube is often exceedingly small due to structural specifications with regard to installation space requirements.

This also has the result that insulating material breaks off at end surfaces of the compressed insulating tube. In this way, the surface between the conductor and insulating material and between the insulating material and outer tube are further reduced, so that the bushing is even less resistant against impacts, compression, tension, and torsion and the likelihood that exhaust gas can escape.

These problems can be mitigated, but not completely avoided, by placing silicone washers, rubber hoses, or similar parts on the end surfaces during the compression process. These generate a certain amount of axial counterpressure during the compression process, which increases the compression in the edge area and reduces the breaking of the insulating material.

However, there are also problems with regard to the precision of the geometry of the electrical conductor of the bushing that can be reliably achieved with this production method. In many practical applications, the electrical conductor of the bushing is not simply a wire, but instead a connecting pin is required, which has a specific pin geometry on one or both sides of the electrical bushing, for example, a length specified with small spacing tolerances, by which the electrical conductor must protrude beyond the end surfaces of the outer tube and insulating material and/or a specified shape, e.g., a conical section in order to provide a particularly flat contact to an electrical pin, as well as a high surface quality.

Problems in meeting spacing tolerances and other requirements for the shape of the contact element are caused especially by the compression processing step. This process results in an elongation of the material, which could mean that the spacing tolerances are not achieved in a safe and reliable way, so that a significant number of rejects is produced.

Another procedure known from DE 10 2012 110 098 B4 consists in providing the electrical bushing, inner conductor, insulating material, and outer tube as a compressed, preassembled bar material and cutting out from this bar material the exposed conductor sections of the inner sheath as contacts and providing them with the desired outer contours, for example, by cutting a thread in the inner conductor cut out of the bar material. This provides a reliable solution to the problem of the spacing tolerances. However, this reliability requires a relatively high consumption of materials. Especially in the case of electrical bushings, in which the contact section must be long, large parts of the outer sheath are simply machined away and turned into waste. In addition to the outer sheath, the insulating material, which is often magnesium oxide, is also machined away, thus contaminating the area of the machine used to cut out the inner conductor and resulting in abrasive and wear effects on this machine, which can severely shorten its service life. All this makes the production of such electrical bushings more expensive. The task of the invention is therefore to provide an improved method for producing electrical bushings, which can supply electrical bushings whose quality is comparable with that of bushings produced according to the teaching of DE 10 2012 110 098 B4 but is associated with less material consumption and wear of the machines used to produce the electrical bushings.

BRIEF SUMMARY OF THE INVENTION

The described task is preferably solved by a method with the characteristics described herein. Advantageous constructions of the method are the subject matter of the present disclosure.

The method according to the invention is used for producing an electrical bushing with a multi-part inner conductor, which is thus assembled from multiple parts (that are usually connected to each other in the final electrical bushing) and is arranged at least in some sections in an outer tube made from metal and is electrically insulated from this outer tube by an electrically insulating material.

Here, the inner conductor of the finished bushing comprises at least one contact section protruding out from the outer tube made from metal and a bearing section arranged within the outer tube and compressed with the electrically insulating material and the outer tube made from metal to form a composite for supporting the at least one contact section. Accordingly, the bearing section forms a first part of the multi-part inner conductor and the contact section or sections form a second and optionally additional parts of the multi-part inner conductor.

In the sense of this disclosure, the bearing section is arranged within the outer tube when the contact surface(s) of the bearing section, by means of which the electrical contact between the contact section and the bearing section is created, protrude at least partially from the outer tube.

The method is distinguished in that the at least one contact section and the bearing section compressed with the electrically insulating material and the outer tube made from metal to form a composite for supporting the at least one contact section are prepared as separate assemblies and then connected to each other. In this way it is possible to reduce the material consumption without compromising the quality of the bushing, in particular, its mechanical stability and the geometrical precision of the contact sections of the bushing and simultaneously to avoid production steps that are associated with high wear of the machines used for producing the electrical bushings and for producing the bar material.

In addition, this same bearing assembly can be used for different contact elements, which can contribute to reducing the number of variants.

With regard to the achieved mechanical stability, advantages are produced when the contact section is supported without contact to the electrically insulating material in the bearing section.

It is especially advantageous if the preparation of the assembly with the bearing section compressed with the electrically insulating material and the outer tube made from metal to form a composite includes the step of separating a section of compressed bar material from a metallic inner part, for example, a bar, a tube, or a tube with a core inserted therein, the electrically insulating material, and the outer tube, so that the bearing section is formed from the metallic inner part. In this way, the undesired effects that might be produced in the end regions during the pressing or compression step are avoided.

Compared to the length of an electrical bushing, bar material compressed in this way consists of long sections of outer tube, insulating material, especially in the form of a porous insulating tube or in the form of a powder or granulate, and electrical conductor, which are arranged relative to each other in the way described above and compressed or compacted. This can also be achieved, e.g., by rolling, hammering, or drawing from a larger cross section.

However, it also falls within the scope of the method according to the invention if, for example, the outer tube, electrically insulating material, and metallic inner conductor are prepared in a length that exceeds the provided length of the holding section by, e.g., 10 mm or 20 mm, and then, after the compression to the compressed composite, a preferably complete end section of the compressed composite is removed on one or both sides.

In the embodiment that can be realized with the fewest method steps, the contact section or sections can be simply welded or soldered to one end surface of the metallic inner part forming the bearing section.

In other embodiments of the invention, the preparation of the assembly with the bearing section compressed with the electrically insulating material and the outer tube made from metal to form a composite further comprises the step of forming at least one opening in the metallic inner part forming the bearing section. By means of this measure, on one hand a higher positioning accuracy for the contact section or sections can be achieved. On the other hand, possible contact problems with respect to the electrical contact between the bearing section and the contact section can be reduced, eliminated, or made irrelevant.

The latter is the case especially if the opening is formed in the metallic inner part forming the bearing section so that the opening passes completely through the inner part and the contact section is inserted into the opening so that it protrudes from the opening on both sides. Alternatively, two contact sections could also be inserted from opposite ends of the opening, wherein then the electrical contact between these two contact sections must be guaranteed.

However, the contact section should then be fastened in the opening in such a way that the assembly made from the contact section is sufficiently sealed with the bearing section fastened therein, which means that for a use of the bushing in an exhaust gas duct, the leakage of exhaust gases is stopped or reduced to a tolerable leakage rate, which can be guaranteed, for example, by welding or soldering. Therefore, in this embodiment, conceivable contact problems that might result from the multi-part design of the inner conductor are eliminated, because the contact section passes completely through the bushing. Therefore, in these embodiments it is in principle also possible for the contact section and holding section to be made from different materials, because the electrical conductivity properties of the holding section are of secondary importance; this possibility, however, is often opposed by the high demands on the material properties of the inner conductor.

However, even if the use of the same materials for the holding section and the contact section is required for a given application, especially in connection with the measure that for the preparation of the assembly with the bearing section compressed with the electrically insulating material and the outer tube made from metal to form a composite, a tubular metallic inner part is compressed with the electrically insulating material and the outer tube to form a composite, so that the bearing section is formed from the tubular metallic inner part, in this way the quantity of high-grade and expensive materials that must be used for the metallic inner part can be significantly reduced.

This can also be realized at very high pressures during the compression or compaction process of the tubular bar materials with the electrically insulating material and the outer tube to form a composite, in which there is the risk that the structural stability of a tubular metallic inner part will not withstand the effective pressure, if, during the compression of the tubular bar material, the tube interior of the tubular bar material is filled with a core that is removed from the tube interior after the compression process. This core could be, for example, a calibration mandrel that is subsequently removed or a core made from a low-priced material, e.g., a mild steel, which can then be drilled or machined out.

In another embodiment of the method, it is provided that the at least one opening is formed as a blind hole in the metallic inner part forming the bearing section and one end of the contact section is inserted into the blind hole and fastened there. In this variant, in particular, any leakage that might be produced from the multi-part design of the inner conductor is reliably prevented, because the holding section is not penetrated completely.

It is especially preferred if the opening is formed concentric to the tube center axis of the outer tube, even if this does not coincide with the center axis of the bearing section.

Because the metallic inner part is often displaced or moved out of alignment relative to the bar material during the compression step, it can be advantageous if the position of the bearing section relative to the outer tube is determined before the connection of the contact section to the bearing section and this determination is used for positioning the contact section. In this way it is possible to compensate for any displacements and/or misalignments of the inner conductor that frequently occur during the compression step.

In one advantageous embodiment of the method, the connection of the at least one contact section with the bearing section compressed with the electrically insulating material and the outer tube made from metal to form a composite for supporting the at least one contact section is performed such that an elongation and/or an at least partial structural change of the at least one contact section is prevented. This is guaranteed during soldering and welding, but excludes, in particular, press contacting.

In particular, the method is performed without changing the structure of the at least one contact section after its preparation.

BRIEF DESCRIPTION OF THE SEVERAL VIEWS OF THE DRAWING

The foregoing summary, as well as the following detailed description of the preferred invention, will be better understood when read in conjunction with the appended drawings. For the purpose of illustrating the preferred invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 2A:
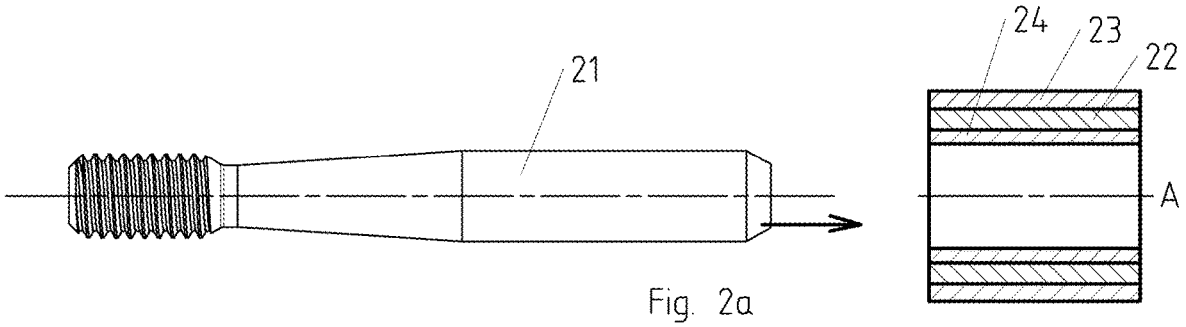
FIG. 2*a* is a side elevational, partial cross-sectional view of a step in producing a first electrical bushing with the method according to the preferred invention.

As can be seen from FIGS. 2*a,b*, 3*a,b*, 4*a,b*, 5*a,b* and 6, it is preferred for the method according to the invention that the respective electrical bushings 20, 30, 40, 50, 60 and especially their inner conductor is assembled from at least two separate assemblies, namely at least one contact section 21, 31*a*, 31*b*, 41, 51*a*, 51*b*, 61*a*, 61*b* as a first assembly and a bearing section 24, 34, 44, 54, 64 compressed with electrically insulating material 22, 32, 42, 52, 62 and an outer tube 23, 33, 43, 53, 63 made from metal to form a composite and arranged completely within the outer tube 22, 33, 43, 53, 63 made from metal for supporting the at least one contact section 21, 31*a*, 31*b*, 41, 51*a*, 51*b*, 61*a*, 61*b* as a second assembly, which is referred to collectively below as "bearing assembly."

Figure 1B:
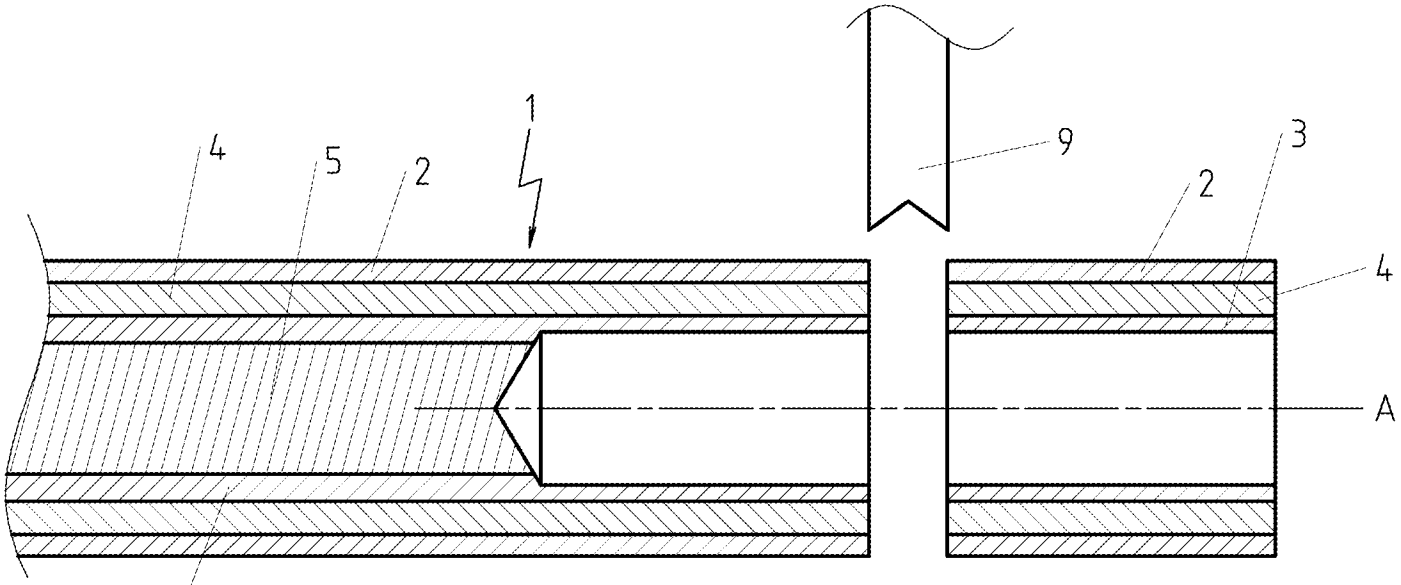
FIG. 1*b* is a cross-sectional view of a second intermediate stage in the preparation of the assembly for the bushing of FIG. 1*a*.
Figure 1A:
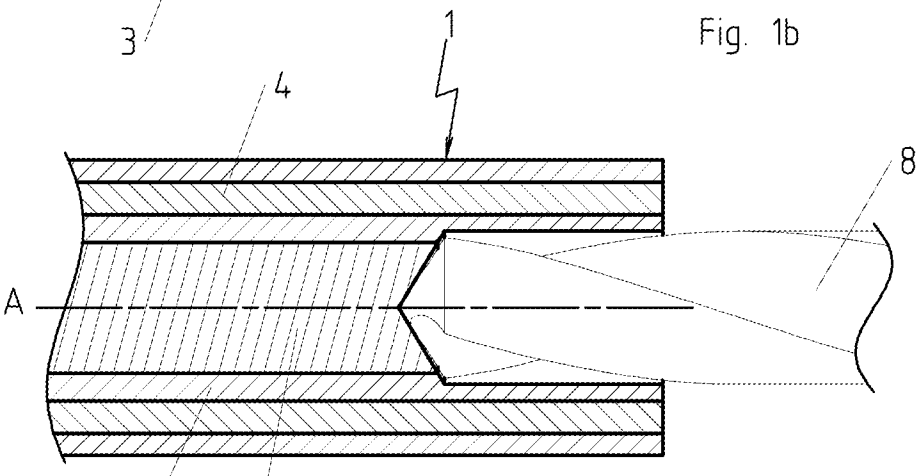
FIG. 1*a* is a cross-sectional view of a first intermediate stage in the preparation of an assembly for the bushing of a method according to the preferred invention.

For preparing the bearing assembly, as can be seen, in particular, from FIGS. 1*a* and 1*b*, a bar material 1 can be used that was produced by compressing a metallic inner part 3 held in the interior of an outer tube 2 made from metal and electrically insulated from this outer tube by an electrically insulating material 4, for example, by molded parts made from magnesium oxide, magnesium oxide powder or magnesium oxide granulate.

The metallic inner part, which is used later for forming the bearing section 24, 34, 44, 54, 64 of the inner conductor of the electrical bushing 20, 30, 40, 50, 60, can be solid; however, in the embodiments shown in FIGS. 1*a* and 1*b*, the metallic inner part 3 has a tubular design and is filled with a core 5, in order to guarantee dimensional stability during the compression step, which must be performed at a high pressure, so that the porosity of the electrically insulating material 4 is sufficiently reduced. The core 5 is not required in all cases; just the use of a tubular metallic inner part might be sufficient.

Figure 6:
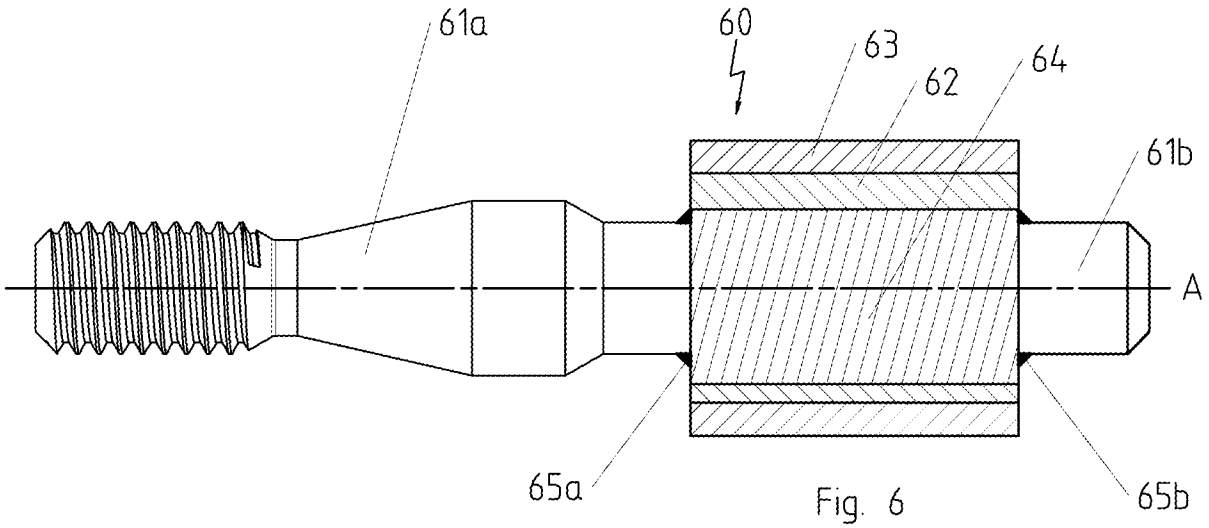
FIG. 6 is a side elevational, partial cross-sectional view of a sixth electrical bushing that can be produced with a method according to the preferred invention.

The simplest bearing assembly used in the embodiment of the electrical bushing 60 as per FIG. 6 is produced simply by cutting a section of the required length from the bar material 1, which is here performed with the tool 9. The separately produced contact sections 61*a*, 61*b* can then be welded or soldered on both sides to the end sides at solder or weld spots 65*a*, 65*b* to the bearing section 64, which is formed simply by the metallic inner part 3 which in this embodiment has a preferably not tubular but solid construction.

Here, in the example of the electrical bushing shown, when the bearing assembly was prepared, the metallic inner part 3 became offset during the production of the bar material, and this offset caused the inner part to be asymmetric relative to the center axis of the outer tube 63 and that the thickness of the electrically insulating material 4 is different in different directions. The separately produced contact sections 61*a*, 61*b*, however, are centered relative to the outer tube 63 made from metal.

In principle, such an offset can also be present in all other subsequently described embodiments and compensated during the connection of the respective contact sections 21, 31*a*, 31*b*, 41, 51*a*, 51*b*, 61*a*, 61*b* and the respective bearing assembly 20, 30, 40, 50, 60.

Figure 2B:
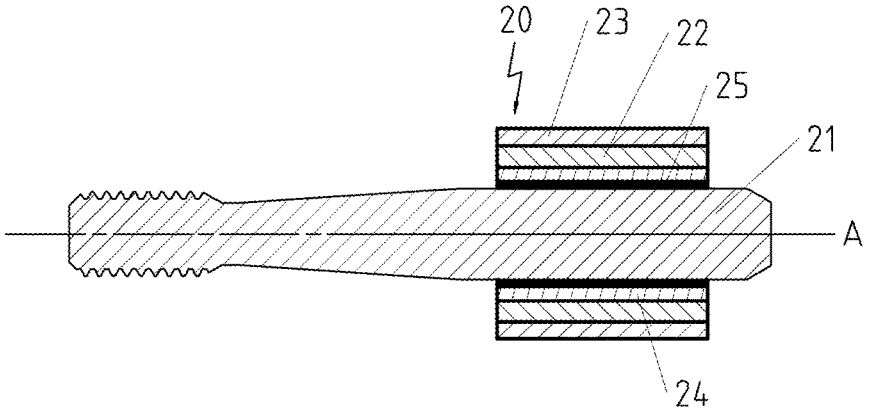
FIG. 2*b* is a cross-sectional view of the electrical bushing produced by the preferred method.

To realize the bearing assembly used in the embodiment of the electrical bushing 20 as per FIGS. 2*a* and 2*b*, an opening 6 must be formed in the metallic inner part 3, as shown in FIGS. 1*a* and 1*b*, before cutting off a section 1*a* of the bar material 1 using the tool 9, in order to form the bearing section 24, for example, as shown in FIG. 1*a* with a drill 8 to a depth that is greater than the desired length of the bearing assembly. In this process, any core 5 that is present can also be drilled out at the same time. When forming the opening 6, this should preferably be centered relative to the outer tube 2.

As shown in FIG. 2*a*, 2*b*, a separately produced contact section 21 can then be easily inserted into the bearing assembly and connected to this, for example, by a solder ring 25. However, it is important that the annular gap between the contact section 21 and the bearing section 24 is sealed sufficiently by the solder ring 25 so that the leakage rate is sufficiently low for the planned application.

Figure 3A:
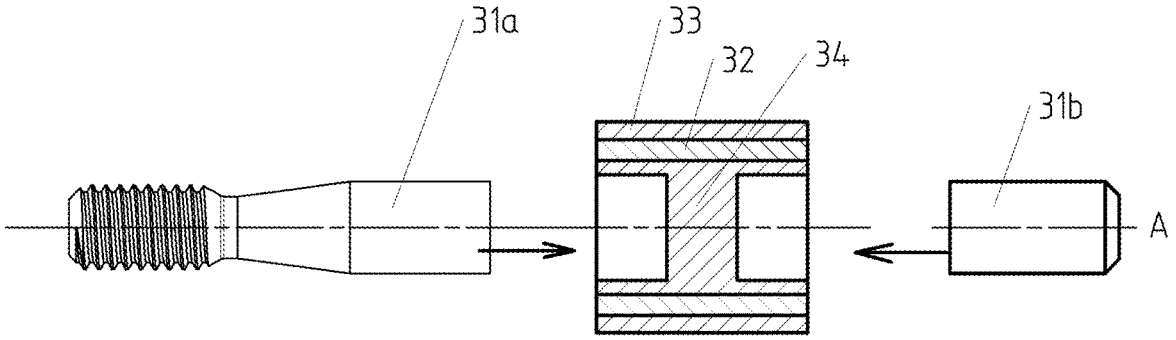
FIG. 3*a* is a side elevational, partial cross-sectional view of a step in producing a second electrical bushing with the method according to the preferred invention.
Figure 3B:
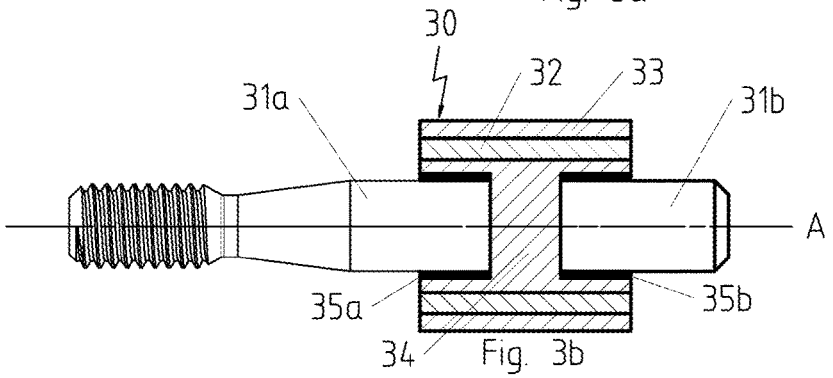
FIG. 3*b* is a side elevational, partial cross-sectional view of the electrical bushing produced by the preferred method.

If such problems are to be avoided, a construction of the bearing assembly as shown in FIGS. 3*a* and 3*b* is possible. In this design, openings are formed in the metallic inner part 3 for forming the bearing section from both sides in such a way that a partition wall made from the material of the metallic inner part 3 remains between them. This can be realized either after cutting off a piece of the desired length from the bar material 1 from both sides or from one side before the cutting and from the other side after the cutting. Then the separately produced assemblies in the form of the contact sections 31*a*, 31*b* are inserted into these openings and fastened with solder rings 35*a*, 35*b*.

Figure 4A:
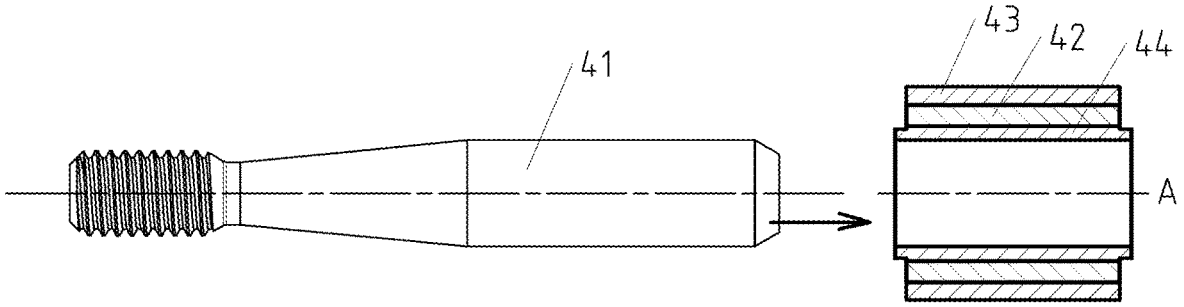
FIG. 4*a* is a side elevational, partial cross-sectional view of a step in producing a third electrical bushing with the method according to the preferred invention.
Figure 4B:
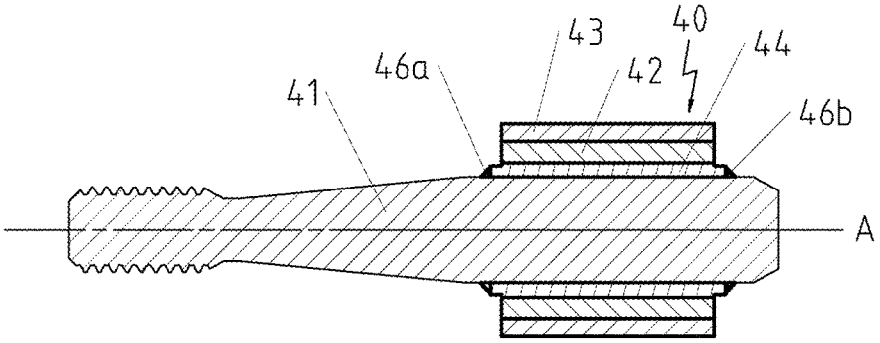
FIG. 4*b* is a cross-sectional view of the electrical bushing produced by the preferred method.

The electrical bushing 40 shown in FIGS. 4*a* and 4*b* differs from the electrical bushing 20 of FIGS. 2*a* and 2*b* with respect to the bearing assembly and the type of fastening of the contact section 41 in the bearing section 44, which is made possible by the other bearing assembly. Here, during the preparation of the bearing assembly, a narrow ring of the outer tube and the electrically insulating material 4 is removed, e.g., machined, on both ends, so that a weld lip is produced on both sides on the end of the bearing section 44, on which a welded connection 46*a*, 46*b* is produced. Here, care must also be taken to ensure that the welded connections 46*a*, 46*b* guarantee the tightness of the annular gap. It can be seen immediately that the contact surface(s) of the bearing section 44, by means of which the electrical contact between the contact section 41 and the bearing section 44 protrude at most partially from the outer tube 43, so that the bearing section 41 is arranged in the sense of this description within the outer tube 43.

Figure 5A:
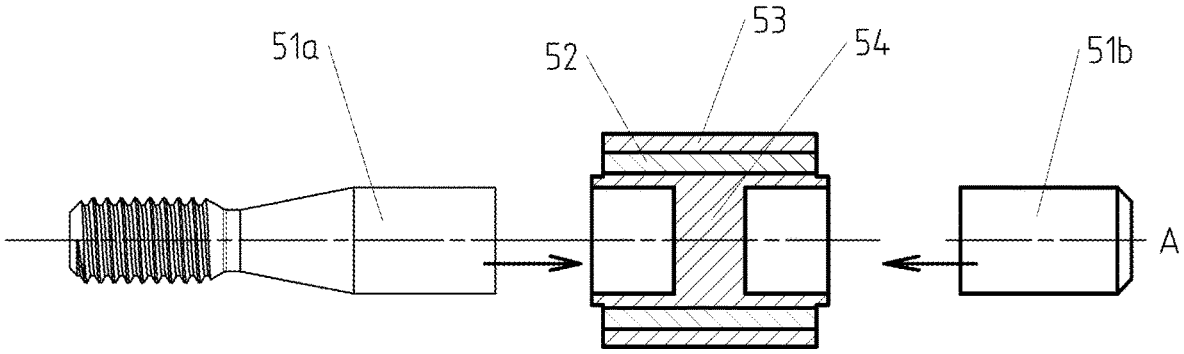
FIG. 5*a* is a side elevational, partial cross-sectional view of a step in producing a fourth electrical bushing with the method according to the preferred invention.
Figure 5B:
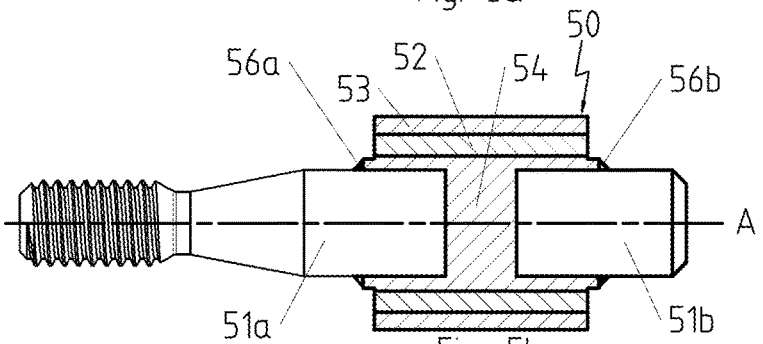
FIG. 5*b* is a side elevational, partial cross-sectional view of the electrical bushing produced by the preferred method.

The electrical bushing 50 shown in FIGS. 5*a* and 5*b* differs from the electrical bushing 30 of FIGS. 3*a* and 3*b* with respect to the bearing assembly and the type of fastening of the contact section 51 in the bearing section 54, which is made possible by the other bearing assembly. As in the embodiment of FIGS. 4*a* and 4*b*, a narrow ring of the outer tube 2 and the electrically insulating material 4 is also removed, e.g., trimmed, here at both ends during the preparation of the bearing assembly, so that a weld lip at which a welded connection 56*a*, 56*b* is generated is produced on both sides at the end of the bearing section 54.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

LIST OF REFERENCE SYMBOLS

1 Bar material
3 Metallic inner part
5 Core
20,30,40,50,60 Electrical bushing
21,31*a*,31*b*,41,51*a*,51*b*,61*a*,61*b* Contact section
4,22,32,42,52,62 Electrically insulating material
2,23,33,43,53,63 Outer tube
24,34,44,54,64 Bearing section
25,35*a*,35*b* Solder ring
46*a*,46*b*,56*a*,56*b* Welded connection
65*a*,65*b* Solder or weld spot
A Center axis of the outer tube

The invention claimed is:

1. A method for producing an assembly of an electrical bushing with a multi-part inner conductor at least partially arranged within an outer tube made from metal, the multi-part inner conductor having at least one contact section made from metal and a discrete bearing section, the method comprising:

arranging an electrically insulating material within the outer tube;

arranging the bearing section within the outer tube, whereby the electrically insulating material is interposed therebetween;

radially compressing the outer tube and the electrically insulating section upon the bearing section therein, thereby forming a composite to support the at least one contact section; and at least partially inserting the at least one contact section within the bearing section of the composite.

2. The method according to claim 1, wherein the at least one contact section is supported without contact to the electrically insulating material in the bearing section.

3. The method according to claim 1, wherein connecting the at least one contact section to the bearing section compressed with the electrically insulating material and the outer tube made from metal for supporting the at least one contact section is carried out such that an elongation or an at least partial structural change of the at least one contact section is prevented.

4. The method according to claim 1, wherein the method after preparing the at least one contact section has no method steps in which the structure of the at least one contact section is changed.

5. A method for producing an assembly of an electrical bushing with an inner conductor arranged at least in some sections in an outer tube made from metal and electrically insulated from the outer tube by an electrically insulating material, wherein the inner conductor of the electrical bushing has at least one contact section protruding out of the outer tube made from metal and a bearing section that is arranged within the outer tube and that is compressed with the electrically insulating material and the outer tube made from metal to form a composite for supporting the at least one contact section, wherein in the method, the at least one contact section and the bearing section compressed with the electrically insulating material and the outer tube made from metal to form the composite for supporting the at least one contact section are prepared as separate assemblies and then connected to each other, wherein providing the assembly with the bearing section compressed with the electrically insulating material and the outer tube made from metal to form a composite includes the step of separating a section of a compressed bar material made from a metallic inner part, the electrically insulating material, and the outer tube, so that the bearing section is formed from the metallic inner part.

6. The method according to claim 5, wherein the at least one contact section is welded or soldered to one end side of the metallic inner part forming the bearing section.

7. The method according to claim 5, wherein providing the assembly with the bearing section compressed with the electrically insulating material and the outer tube made from metal to form the composite also has the step of forming at least one opening in the metallic inner part forming the bearing section.

8. The method according to claim 7, wherein the at least one opening is formed in the metallic inner part forming the bearing section so that the at least one opening passes completely through the metallic inner part, the at least one contact section is pushed into the at least one opening so that the at least one contact section protrudes out of the at least one opening on both sides of the metallic inner part, and the at least one contact section is fixed in the at least one opening such that the assembly made from the at least one contact section is sealed with the bearing section fixed therein.

9. The method according to claim 7, wherein the at least one opening is formed as a blind hole in the metallic inner part forming the bearing section and one end of the at least one contact section is pushed into the blind hole and fixed therein.

10. The method according to claim 7, wherein the at least one opening is formed concentric to a center axis of the outer tube.

11. The method according to claim 5, wherein before connecting the at least one contact section to the bearing section, a position of the bearing section relative to the outer tube is determined and the determination is used for positioning the at least one contact section.

12. The method according to claim 5, wherein for providing the assembly with the bearing section compressed with the electrically insulating material and the outer tube made from metal to form the composite, a tubular metallic inner part is compressed with the electrically insulating material and the outer tube made from metal so that the bearing section is formed from the tubular metallic inner part.

13. The method according to claim 12, wherein during the compression of the tubular metallic inner part with the outer tube and the electrically insulating material to form the composite, an interior of the tubular metallic inner part is filled with a core that is removed from the interior after the compression.

* * * * *